US008118612B2

(12) United States Patent
Morikawa

(10) Patent No.: US 8,118,612 B2
(45) Date of Patent: Feb. 21, 2012

(54) END-PROCESSING METHOD OF COAXIAL CABLE AND END-PROCESSING STRUCTURE OF COAXIAL CABLE

(75) Inventor: Taishi Morikawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/673,781

(22) PCT Filed: Aug. 27, 2008

(86) PCT No.: PCT/JP2008/065305
§ 371 (c)(1),
(2), (4) Date: Feb. 17, 2010

(87) PCT Pub. No.: WO2009/028556
PCT Pub. Date: Mar. 5, 2009

(65) Prior Publication Data

US 2011/0065316 A1 Mar. 17, 2011

(30) Foreign Application Priority Data

Aug. 28, 2007 (JP) ..... 2007-221245

(51) Int. Cl.
*H01R 9/05* (2006.01)

(52) U.S. Cl. ..... 439/578; 29/868

(58) Field of Classification Search ..... 439/578, 439/877; 174/85 C, 85 R, 75 C, 74 R; 29/868
See application file for complete search history.

(56) References Cited

U.S. PATENT DOCUMENTS 4,688,878 A * 8/1987 Cohen et al. ..... 439/585
5,073,128 A * 12/1991 Sirai et al. ..... 439/585
5,195,906 A * 3/1993 Szegda ..... 439/394
5,207,596 A * 5/1993 Tran ..... 439/585
5,217,392 A * 6/1993 Hosler, Sr. ..... 439/585
5,432,301 A * 7/1995 Gehring ..... 174/78
6,107,572 A * 8/2000 Miyazaki ..... 174/75 C
6,175,080 B1 * 1/2001 Nightingale ..... 174/75 C
6,217,383 B1 * 4/2001 Holland et al. ..... 439/578

(Continued)

FOREIGN PATENT DOCUMENTS

JP 7-288161 A 10/1995

(Continued)

*Primary Examiner* — Tulsidas C Patel
*Assistant Examiner* — Harshad Patel
(74) *Attorney, Agent, or Firm* — Sughrue Mion, PLLC

(57) ABSTRACT

To provide an end-processing structure of a coaxial cable, in which a catching engagement less liable to invite damage is achieved, a high tensile strength can be obtained, and also the reliability can be enhanced. A folded braid portion 24 is formed by folding an annular projecting braid portion 23 from its proximal end portion 34 so as to superpose the folded annular projecting braid portion on one insulative sheath 31*a*. When the proximal end portion 34 of the annular projecting braid portion 23 is bent, a terminal catching portion 35 is formed at the folded braid portion 24. Even when a strong force is applied in a direction of withdrawing of a coaxial connector 22, the terminal catching portion 35 of the folded braid portion 24 and a pair of sheath press-clamping portions 40 are caught and engaged with each other, and also the terminal catching portion 35 and a step portion 41 of a press-clamping portion 37 are caught and engaged with each other, that is, the metallic portions are caught and engaged with each other.

6 Claims, 8 Drawing Sheets

U.S. PATENT DOCUMENTS

| | | | | |
|---|---|---|---|---|
| 6,648,683 | B2 * | 11/2003 | Youtsey | 439/578 |
| 6,835,096 | B2 | 12/2004 | Togashi | |
| 6,951,483 | B2 | 10/2005 | Kameyama | |
| 7,291,043 | B2 | 11/2007 | Morikawa | |
| 7,425,161 | B2 | 9/2008 | Morikawa | |
| 7,695,332 | B2 * | 4/2010 | Morikawa et al. | 439/877 |
| 2002/0164900 | A1 * | 11/2002 | Youtsey | 439/578 |
| 2005/0282434 | A1 * | 12/2005 | Morikawa | 439/578 |
| 2006/0216998 | A1 * | 9/2006 | Morikawa et al. | 439/610 |
| 2006/0264099 | A1 * | 11/2006 | Morikawa | 439/578 |

FOREIGN PATENT DOCUMENTS

| | | | |
|---|---|---|---|
| JP | 2000-260540 | A | 9/2000 |
| JP | 2001-357960 | A | 12/2001 |
| JP | 2004-055475 | A | 2/2004 |
| JP | 2004-319175 | A | 11/2004 |
| JP | 2006-269142 | A | 10/2006 |
| JP | 2006-302722 | A | 11/2006 |

* cited by examiner

END-PROCESSING METHOD OF COAXIAL CABLE AND END-PROCESSING STRUCTURE OF COAXIAL CABLE

TECHNICAL FIELD

The present invention relates to a method of processing an end of a coaxial cable to which a shield terminal for coaxial cable forming a coaxial connector is electrically and mechanically connected, and also to a end-processing structure of a coaxial cable.

BACKGROUND ART

Generally, a coaxial cable used for transmitting high-frequency signals as in an antenna wire includes, in outward order from the center, a core wire as a center conductor, an insulator as a dielectric, a metallic tape conductor and a braid as an outer conductor, and an insulative sheath as an outer covering. The coaxial cable of such a construction has a coaxial connector provided at an end thereof so that the coaxial cable can be connected to a mating equipment, a mating coaxial cable or the like. The coaxial connector has a shield terminal for coaxial cable through which the braid is groundedly connected to a mating coaxial connector so as to cutoff electrical noises such as electromagnetic waves and static electricity.

With respect to an end-processing structure of a coaxial cable (the structure of connecting a coaxial cable and a coaxial connector together), the following structure has been proposed. Namely, there is carried out an operation in which first, a braid is exposed at an end portion of the coaxial cable, and then the exposed braid is undone, and a connecting conductor portion of the coaxial connector is inserted into a gap between the undone braid and a metallic tape conductor (or an insulator) disposed inside the braid. Then, an operation for press-fastening a metallic sleeve, separate from the coaxial cable and the coaxial connector, at the position of the above exposed braid is effected. By press-fastening the metallic sleeve, the coaxial cable and the coaxial connector are electrically and mechanically connected together (see, for example, Patent Literature 1).

In order that the contours of cross-sections of the insulator and the outer conductor are not deformed out of a concentric condition, in other words, in order to satisfy high-frequency characteristics, the above end processing structure has such a structure that the connecting conductor portion of the coaxial connector is inserted into the gap between the braid and the metallic tape conductor (or the insulator) disposed inside the braid. Such a connecting structure also aims at satisfying a predetermined tensile strength of the coaxial cable and the coaxial connector.

Incidentally, in the above end processing structure, it is necessary to carry out the operation for once undoing the braid, exposed at the end portion of the coaxial cable, in order to insert the connecting conductor portion of the coaxial connector into the inside of the braid of the coaxial cable. Therefore, the conventional end processing structure has a problem that the efficiency of the operation is affected since the cumbersome operation must be carried out.

Furthermore, in the above end processing structure, there is required the production and operation, in which the metallic sleeve separate from the coaxial cable and the coaxial connector is prepared, and is attached. Therefore, the above end processing structure has problems that the number of parts increases and that the efficiency of the operation is affected. With respect to the resolution of the problem that the number of the parts increases, consideration for satisfying the predetermined tensile strength of the coaxial cable and the coaxial connector is necessary.

A technique for solving the above problems is disclosed in the following Patent Literature 2. This will be briefly described below.

In FIG. 11, when a connecting conductor portion 14 of a shield terminal 10 forming a coaxial connector 9 is pushed in a cable-extending direction, an annular braid gathered portion 8 composed of a braid 4 is formed between an insulator 3 and an insulative sheath 5. The braid gathered portion 8 is formed by causing a gathered portion to be produced at the braid 4 by the pushing-in of the connecting conductor portion 14. In accordance with the formation of this braid gathered portion 8, a terminal catching portion 7 in the form of an annular bulge is formed at the insulative sheath 5. When the terminal catching portion 7 is formed, a coaxial cable 6 which is a feature of Patent Literature 2 is formed.

In the condition in which the coaxial cable 6 is formed, the connecting conductor portion 4 is kept inserted between those portions of the insulator 3 and the insulative sheath 5 disposed at the front side of the terminal catching portion 7. The connecting conductor portion 14 and the braid gathered portion 8 are contacted with each other, and therefore an electrical connection is formed in a provisional condition.

When a sheath holding portion 15 and a second sheath holding portion 16 of the shield terminal 10 are press-fastened to hold the insulative sheath 5 of the coaxial cable 6, a series of operations are completed. The sheath holding portion 15 and the second sheath holding portion 16 are press-fastened on the insulative sheath 5 in a wound condition. At this time, one outer edge portion 18 of the sheath holding portion 15 is press-fastened to be located adjacent to the terminal catching portion 7. Also, the second sheath holding portion 16 is press-fastened in such a condition that the portion of the insulative sheath 5 disposed at the front side of the terminal catching portion 7 is held between the second sheath holding portion 16 and the connecting conductor portion 14.

When the press-fastening of the sheath holding portion 15 and the second sheath holding portion 16 of the shield terminal 10 is completed, the mechanical fixing is completed, and also the electrical connection of the connecting conductor portion 14 and the braid gathered portion 8 to each other is completed in a complete condition.

If a force is applied in a direction of withdrawing of the coaxial connector 9, the one outer edge portion 18 of the sheath holding portion 15 is caught by the terminal catching portion 7 of the coaxial cable 6. The coaxial cable 9 is prevented by the terminal catching portion 7 from movement in the withdrawing direction.

Reference numeral 2 in the drawings denotes a core wire, reference numeral 11 denotes a dielectric, 12 denotes a shield terminal body, 13 denotes a press-clamping portion and reference numeral 17 denotes a base portion of the press-clamping portion 13.

Patent Literature 1: JP-A-2004-55475
Patent Literature 2: JP-A-2006-302722

DISCLOSURE OF THE INVENTION

Problem that the Invention is to Solve

Although the disclosed technique of Patent Literature 2 provides the structure in which the movement of the coaxial connector 9 in the withdrawing direction is prevented by the terminal catching portion 7 of the coaxial cable 6, there is anxiety about the following point.

Namely, the terminal catching portion 7 is the bulged portion of the synthetic resin-made insulative sheath 5, and besides the one outer edge portion 18 of the sheath holding portion 15 of the metallic shield terminal 10 includes a portion formed into an edge-shape, and therefore if damage such as biting and so on develops though achieving the catching when a strong force is applied, for example, in the direction of withdrawing of the coaxial connector 9, it is uncertain whether the movement in the withdrawing direction can be positively prevented, and there is anxiety about this point.

The present invention has been made in view of the above circumstances, and its object is to provide an end-processing method of a coaxial cable and an end-processing structure of a coaxial cable, in which a catching engagement less liable to invite damage is achieved, and a high tensile strength can be obtained, and also the reliability can be enhanced.

Means for Solving the Problem

An end-processing method of a coaxial cable according to a first aspect of the present invention provided to achieve the problem is a method including: stripping an intermediate portion of an insulative sheath of the coaxial cable; drawing one insulative sheath toward the other insulative sheath and projecting a braid annularly outwardly from between end portions of the one and the other insulative sheath in association with the drawing to form an annular projecting braid portion; thereafter folding the annular projecting braid portion from its proximal end portion and superposing the folded annular projecting braid portion on the one insulative sheath to thereby form a folded braid portion; and press-clamping and connecting the folded braid portion by a braid press-clamping portion of a shield terminal for coaxial cable which is to be connected to an end portion of the coaxial cable, and also press-clamping and fixing a sheath press-clamping portion of the shield terminal for coaxial cable to the other insulative sheath disposed near to a terminal catching portion formed at the proximal end portion of the folded braid portion.

In the present invention having these features, even when a strong force is applied, for example, in a direction of withdrawing of the coaxial connector, the metallic portions are caught and engaged with each other, and therefore damage is much less liable to occur as compared with the catching engagement of a synthetic resin-made portion and a metallic portion with each other. Since damage is less liable to occur, a tensile strength is increased, and also the reliability is enhanced.

The end-processing method of the coaxial cable according to a second aspect is a method in the end-processing method of the coaxial cable of the first aspect, wherein a step portion corresponding to the terminal catching portion is formed at a base plate of a press-clamping portion of the shield terminal for coaxial cable, the base plate coupling the braid press-clamping portion to the sheath press-clamping portion.

In the present invention having this feature, the area of the portion caught and engaged with the terminal catching portion is increased, and the tensile strength is further increased. And besides, the positioning relative to the folded braid portion, in other words, the positioning relative to the coaxial cable, becomes easier.

The end-processing method of the coaxial cable according to a third aspect is a method in the end-processing method of the coaxial cable of the first or second aspect, wherein the sheath press-clamping portion is formed into a rectangular shape 15 smaller in width than the braid press-clamping portion.

In the present invention having this feature, the catching engagement less liable to invite damage is sufficiently maintained even when the width of the sheath press-clamping portion is reduced, and the braid press-clamping portion relating to the connection and fixing to the folded braid portion can be increased by an amount corresponding to this width reduction.

An end-processing structure of a coaxial cable according to a fourth aspect of the present invention provided to achieve the problem is a structure including: an annular projecting braid portion which is formed by stripping an intermediate portion of an insulative sheath of the coaxial cable and by causing a braid to project annularly outwardly from between end portions of one insulative sheath and the other insulative sheath in association with the drawing of the one insulative sheath toward the other insulative sheath; and a folded braid portion which is formed by folding the annular projecting braid portion from its proximal end portion so as to superpose the folded annular projecting braid portion on the one insulative sheath, wherein the folded braid portion is press-clamped and connected by a braid press-clamping portion of a shield terminal for coaxial cable which is to be connected to an end portion of the coaxial cable, and also a sheath press-clamping portion of the shield terminal for coaxial cable is press-clamped and fixed to the other insulative sheath disposed near to a terminal catching portion formed at the proximal end portion of the folded braid portion.

In the present invention having these features, even when a strong force is applied, for example, in a direction of withdrawing of the coaxial connector, the metallic portions are caught and engaged with each other, and therefore damage is much less liable to occur as compared with the catching engagement of a synthetic resin-made portion and a metallic portion with each other. Since damage is less liable to occur, a tensile strength is increased, and also the reliability is enhanced.

ADVANTAGE OF THE INVENTION

In the present invention according to the first aspect, by achieving the catching engagement less liable to invite damage, there are achieved advantages that the high tensile strength is obtained and that the reliability is also enhanced.

In the present invention according to the second aspect, there is achieved an advantage that the tensile strength can be further increased. And besides, there is achieved an advantage that the positioning relative to the coaxial cable can be made easier.

In the present invention according to the third aspect, in addition to the above advantages, there is achieved an advantage that the connected condition can be stabilized.

In the present invention according to the fourth aspect, by achieving the catching engagement less liable to invite damage, there are achieved advantages that the high tensile strength is obtained and that the reliability is also enhanced.

DESCRIPTION OF THE REFERENCE NUMERALS

Figure 1:
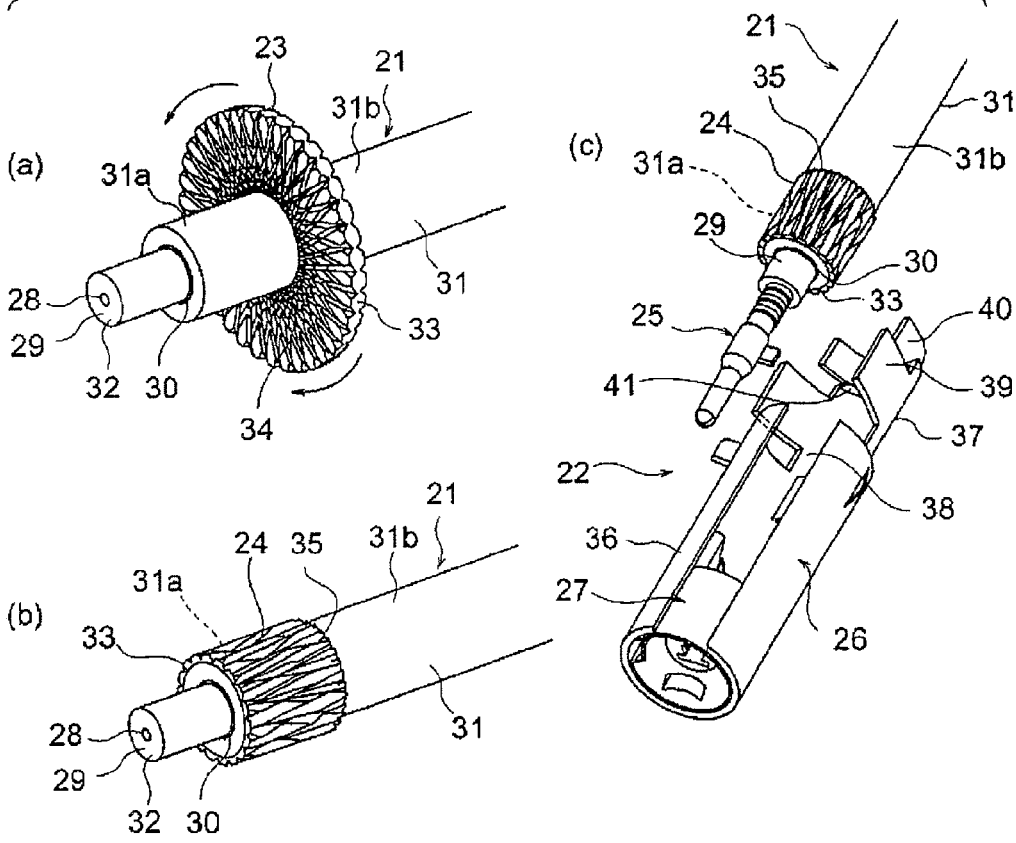
FIG. 1 shows one embodiment of an end-processing structure of a coaxial cable of the present invention, and (a) is a perspective view of an annular projecting braid portion, (b) is a perspective view of a folded braid portion and (c) is an exploded perspective view of the end-processing structure of the coaxial cable.

21 coaxial cable
22 coaxial connector
23 annular projecting braid portion
24 folded braid portion
25 inner terminal
26 shield terminal (shield terminal for coaxial cable)
27 dielectric
28 core wire
29 insulator
30 braid
31 insulative sheath
31*a* one insulative sheath
31*b* the other insulative sheath
32 end face
33 annular outer peripheral edge portion
34 proximal end portion
35 terminal catching portion
36 shield terminal body
37 press-clamping portion
38 base plate
39 braid press-clamping portion
40 sheath press-clamping portion
41 step portion

BEST MODE FOR CARRYING OUT THE INVENTION

Description will be made below with reference to the drawings. FIG. 1 shows one embodiment of an end-processing structure of a coaxial cable of the present invention, and (a) is a perspective view of an annular projecting braid portion, (b) is a perspective view of a folded braid portion and (c) is an exploded perspective view of the end-processing structure of the coaxial cable.

Figure 2:
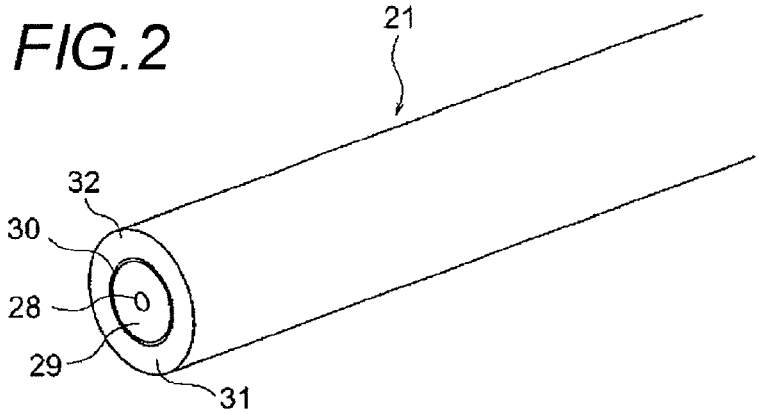
FIG. 2 is a perspective view showing a coaxial cable before the processing.
Figure 3:
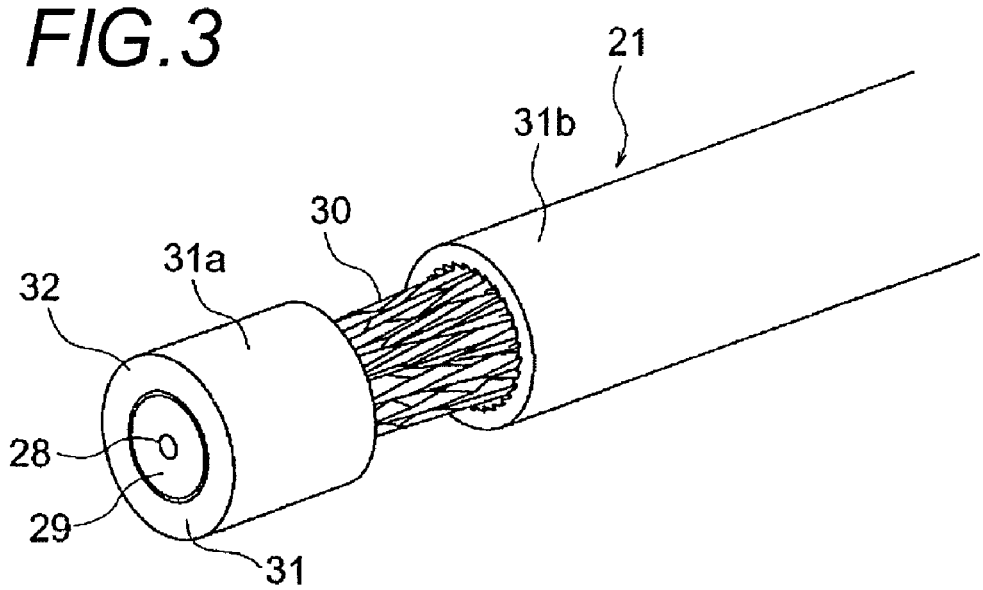
FIG. 3 is a perspective view showing a condition in which an intermediate portion of an insulative sheath of the coaxial cable is stripped.
Figure 4:
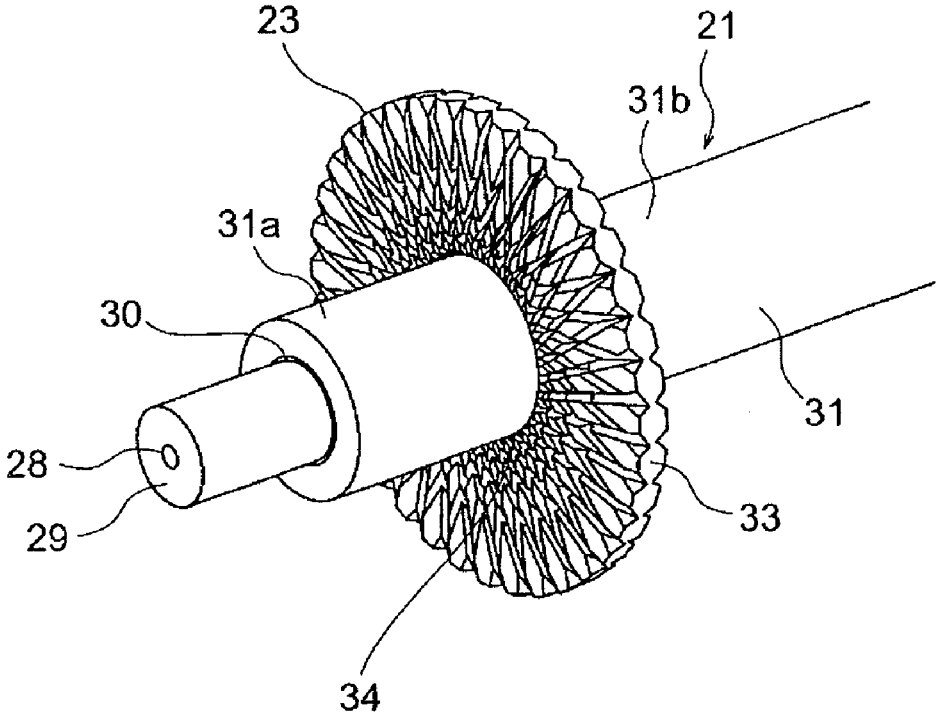
FIG. 4 is a perspective view showing a condition in which the annular projecting braid portion is formed at the coaxial cable.
Figure 5:
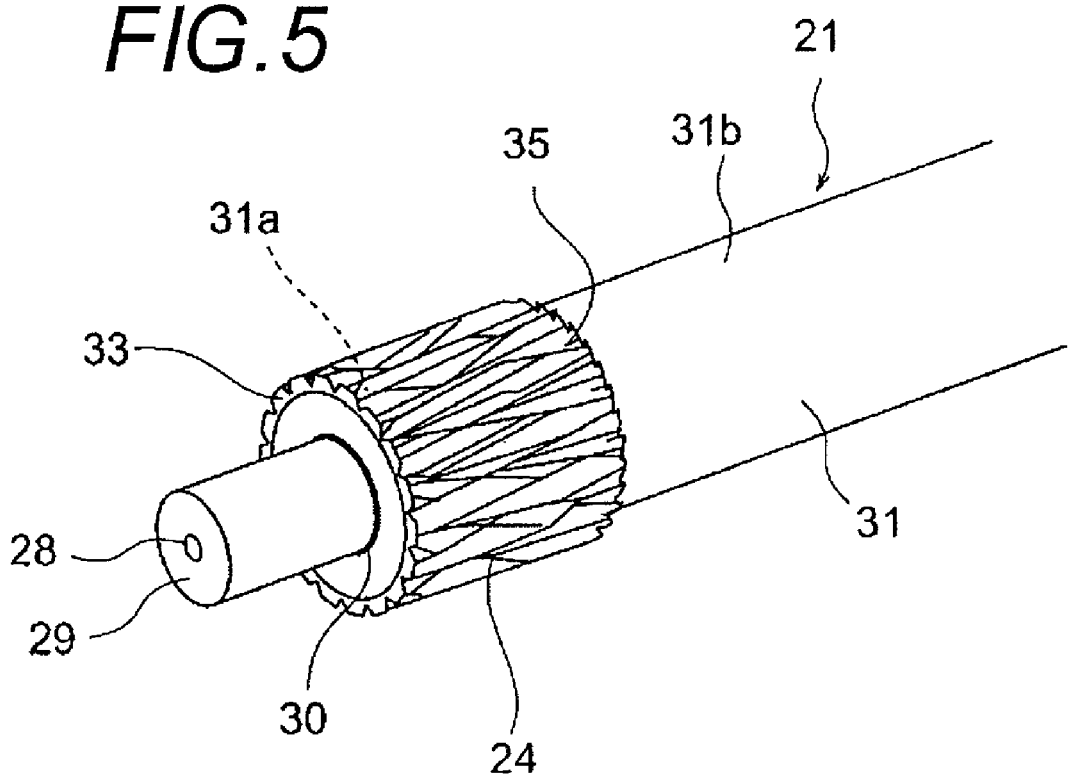
FIG. 5 is a perspective view showing a condition in which the folded braid portion is formed at the coaxial cable.

FIG. 2 is a perspective view showing a coaxial cable before the processing, FIG. 3 is a perspective view showing a condition in which an intermediate portion of an insulative sheath of the coaxial cable is stripped, FIG. 4 is a perspective view showing a condition in which the annular projecting braid portion is formed at the coaxial cable, and FIG. 5 is a perspective view showing a condition in which the folded braid portion is formed at the coaxial cable.

Figure 6:
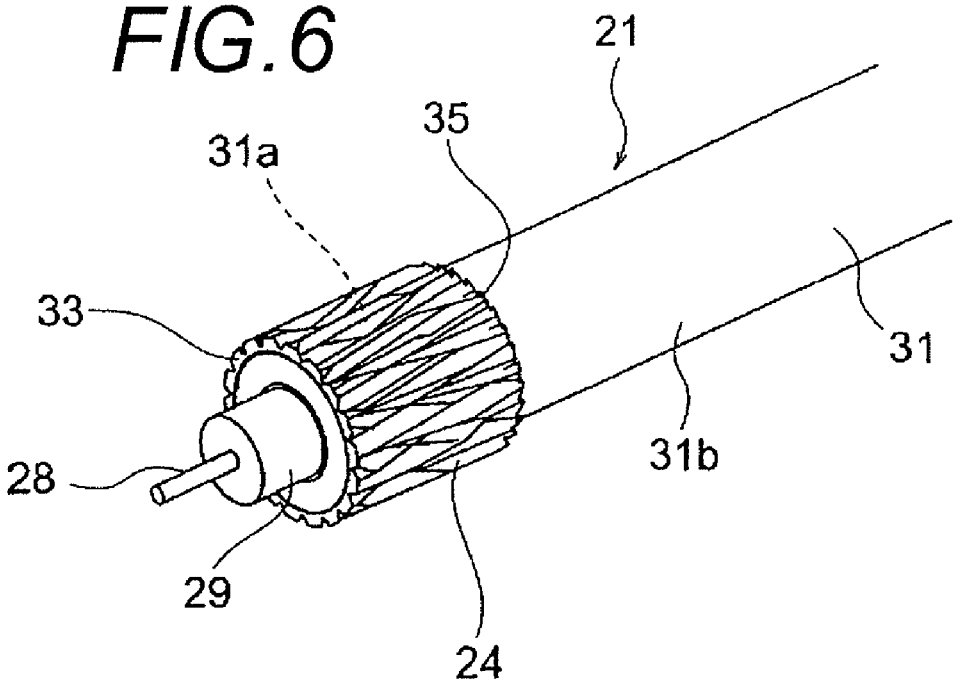
FIG. 6 is a perspective view showing a condition in which a core wire is exposed.
Figure 7:
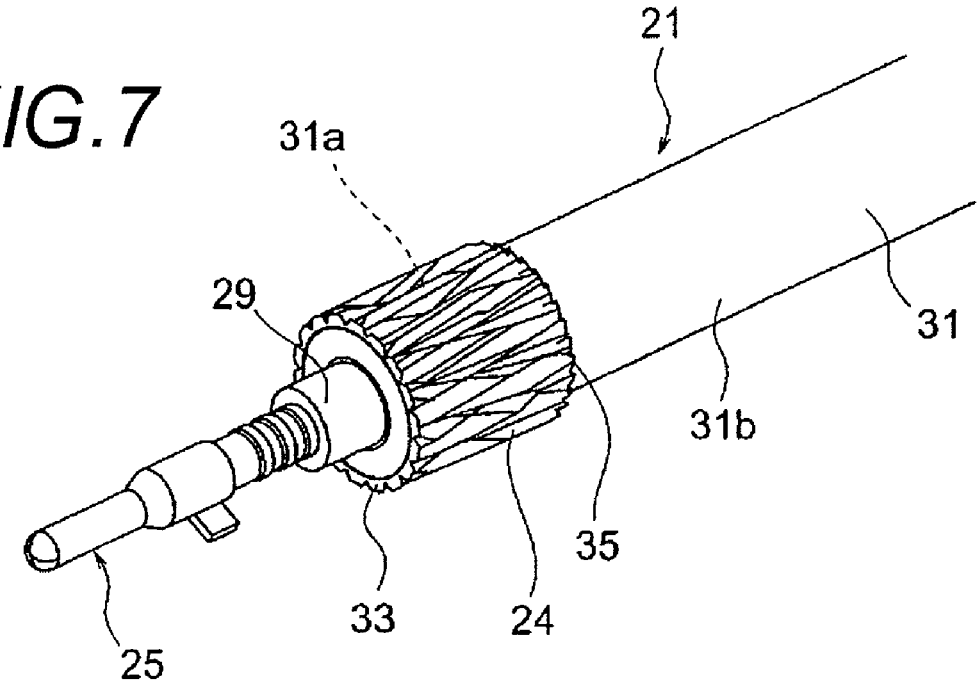
FIG. 7 is a perspective view showing a condition in which an inner terminal is mounted on the core wire.
Figure 8:
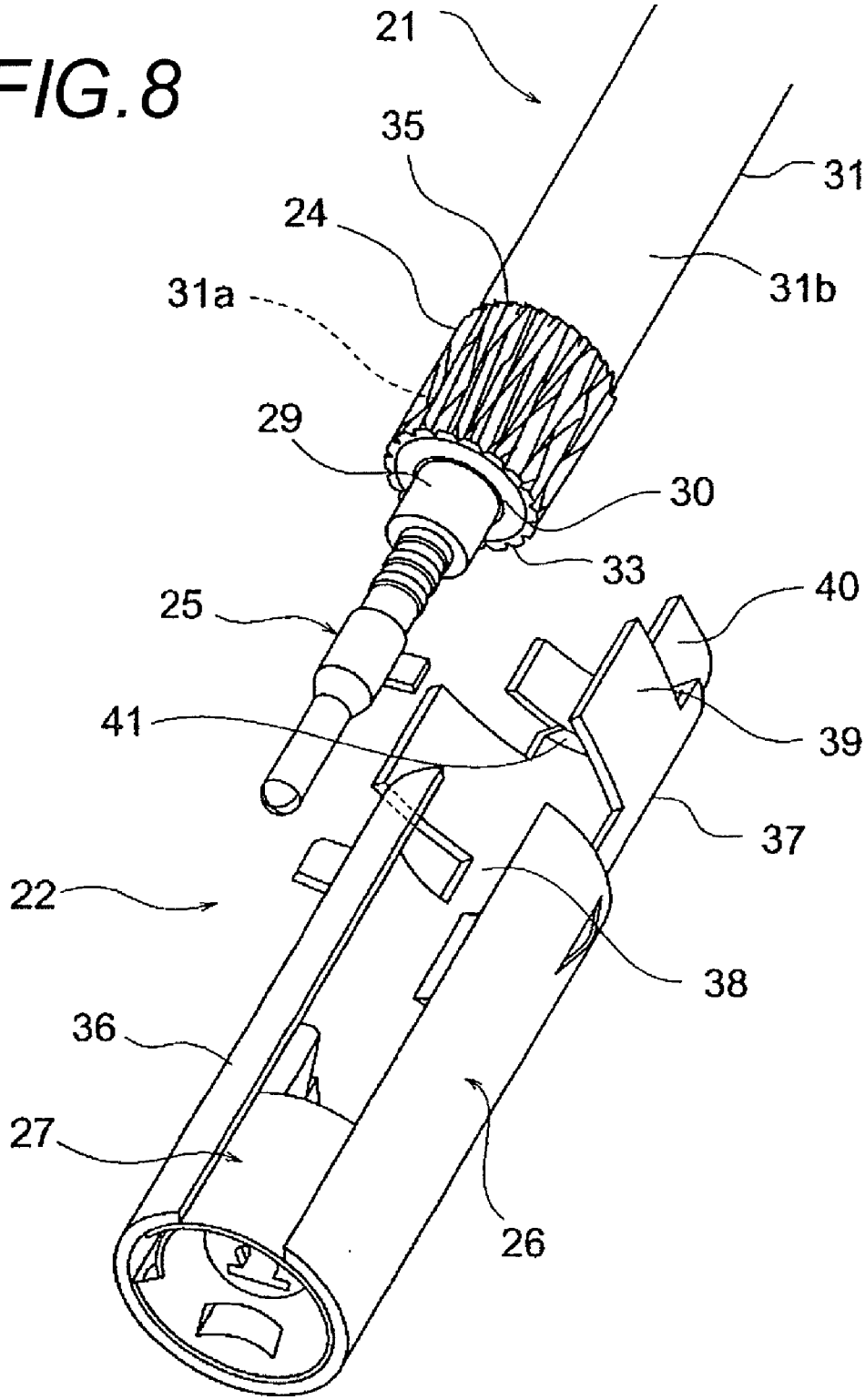
FIG. 8 is a perspective view showing a condition before the coaxial cable is connected to a shield terminal for coaxial cable.
Figure 9:
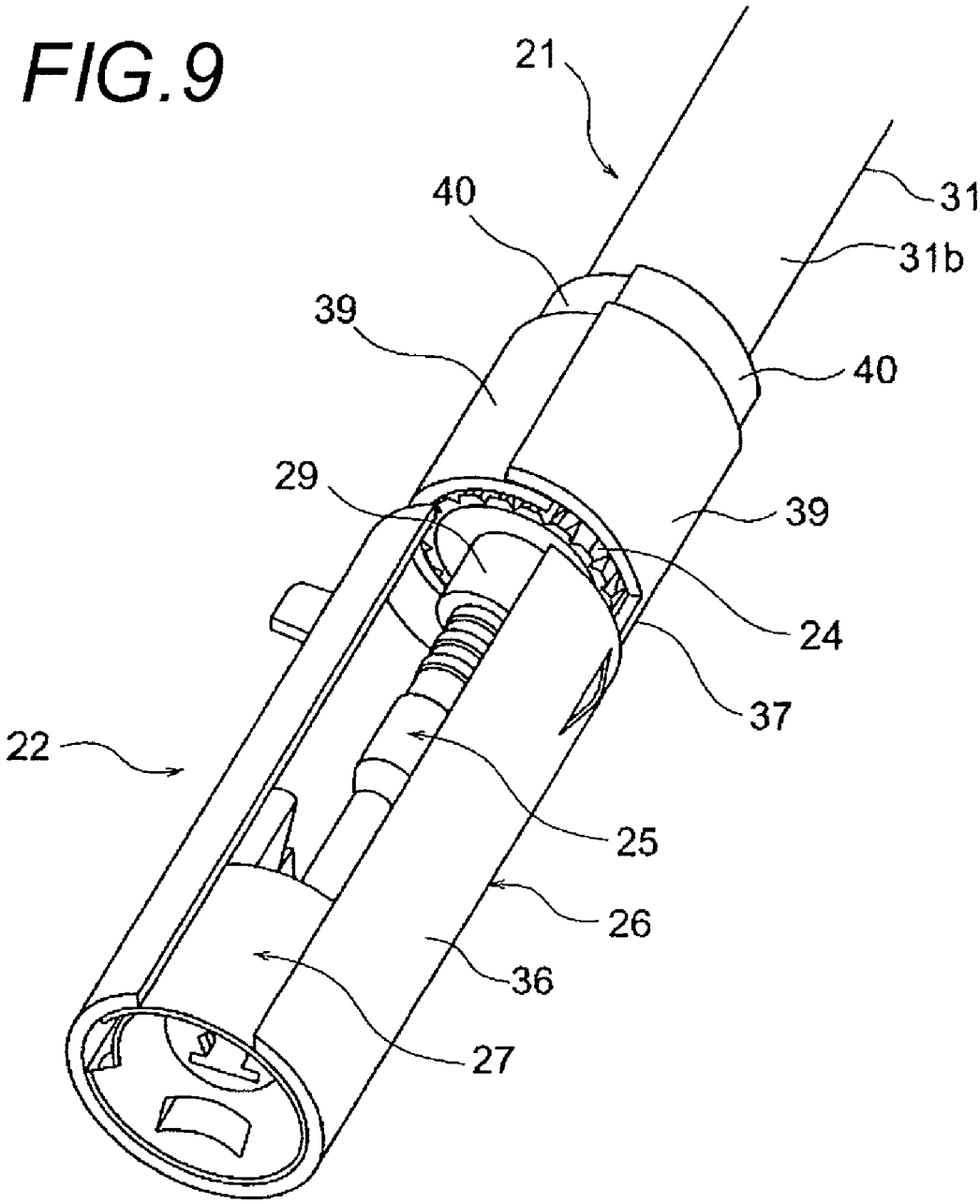
FIG. 9 is a perspective view showing a condition in which braid press-clamping portions are press-clamped to the folded braid portion, and also sheath press-clamping portions are press-clamped to the insulative sheath.
Figure 10:
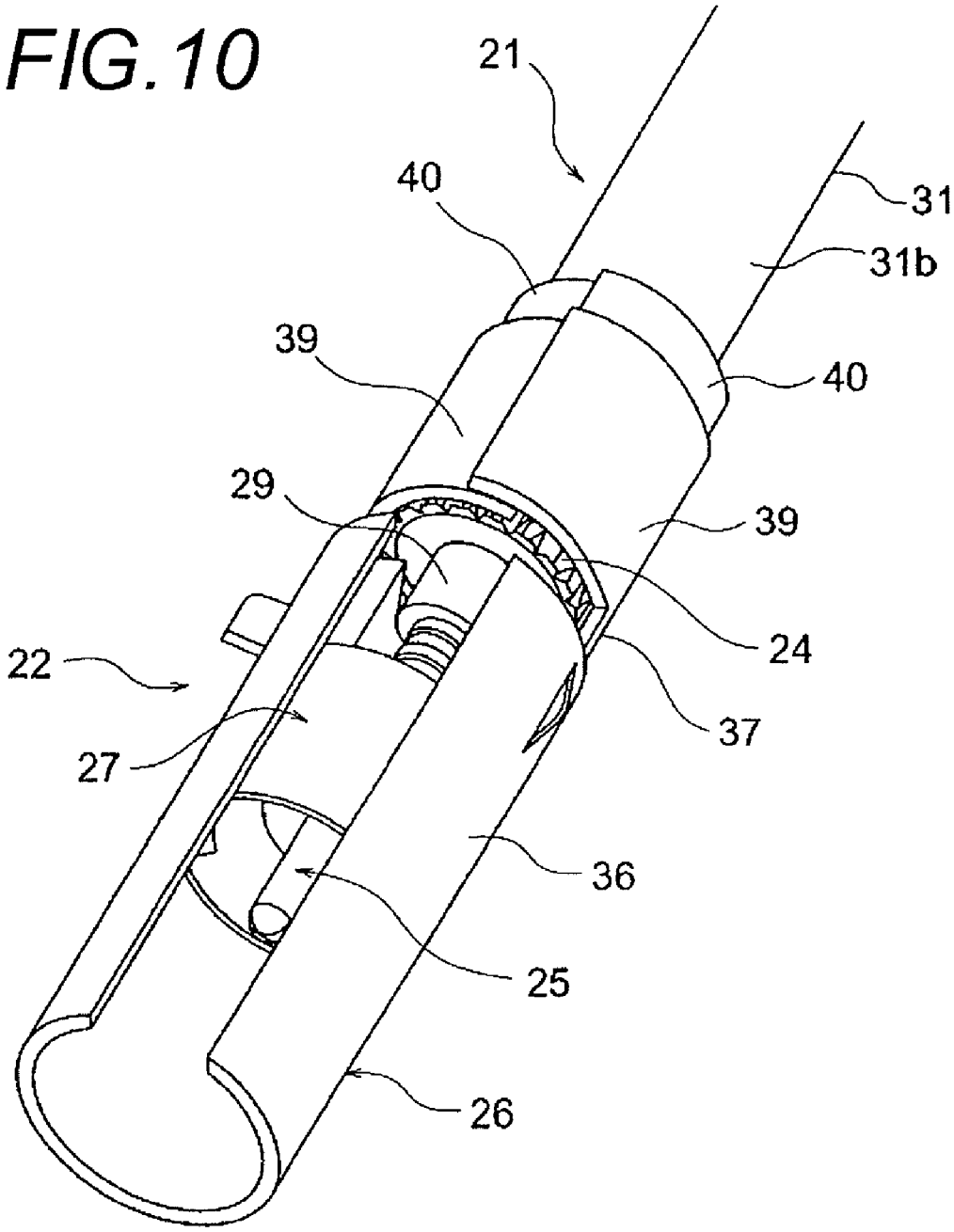
FIG. 10 is a perspective view showing a condition in which the connection of the coaxial cable and the shield terminal for coaxial cable to each other is completed.
Figure 11:
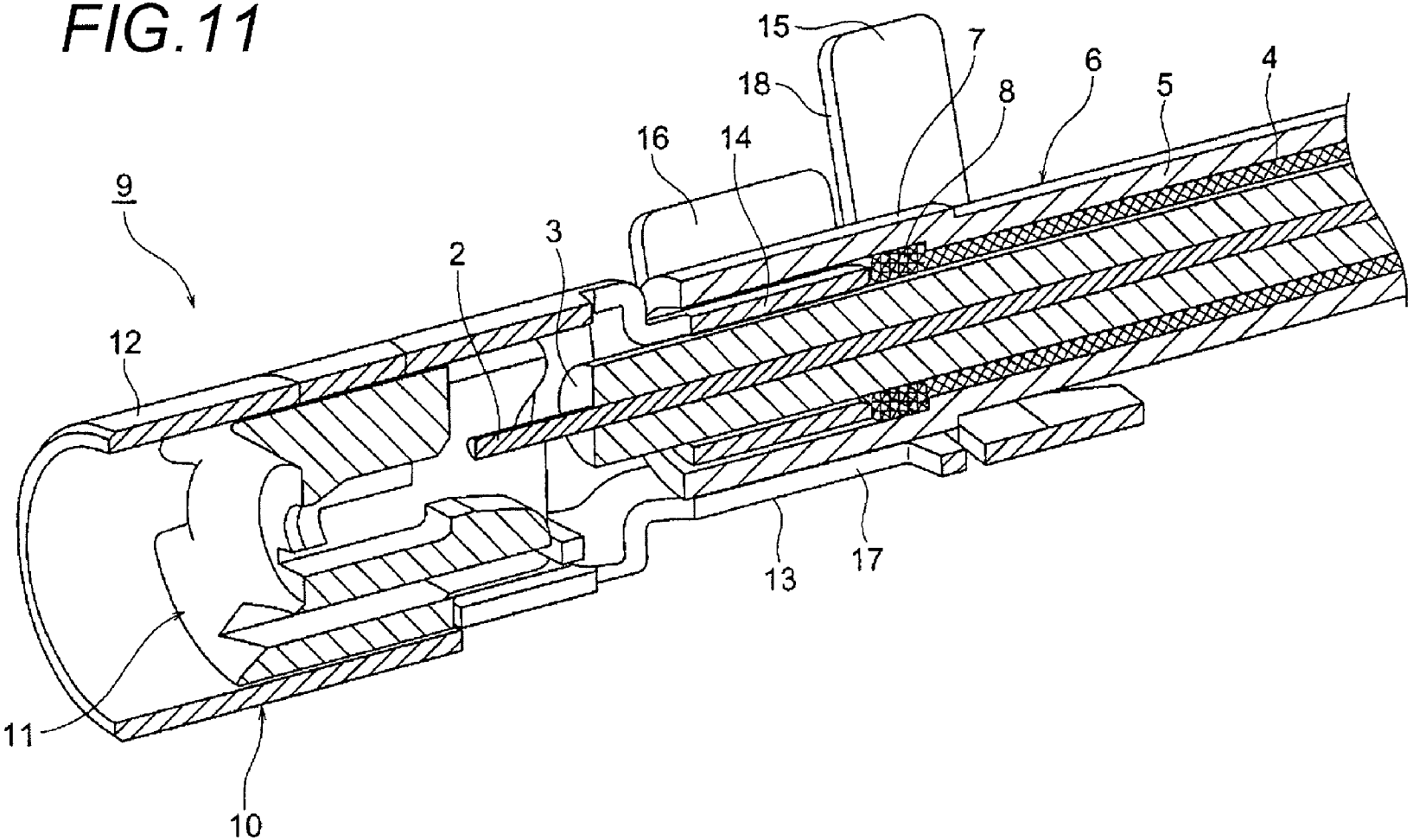
FIG. 11 is a cross-sectional view showing a conventional coaxial cable end-processing structure.

FIG. 6 is a perspective view showing a condition in which a core wire is exposed, FIG. 7 is a perspective view showing a condition in which an inner terminal is mounted on the core wire, FIG. 8 is a perspective view showing a condition before the coaxial cable is connected to a shield terminal for coaxial cable, FIG. 9 is a perspective view showing a condition in which braid press-clamping portions are press-clamped to the folded braid portion, and also sheath press-clamping portions are press-clamped to the insulative sheath, and FIG. 10 is a perspective view showing a condition in which the connection of the coaxial cable and the shield terminal for coaxial cable to each other is completed.

In FIG. 1, reference numeral 21 denotes a coaxial cable. Reference numeral 22 denotes a coaxial connector. As the coaxial cable 21, there is used one in which an annular projecting braid portion 23 is formed, and this is folded to form a folded braid portion 24. The coaxial connector 22 includes an inner terminal 25, a shield terminal (shield terminal for coaxial cable) 26, and a dielectric 27. Each construction will be described hereafter with reference to FIG. 1 to FIG. 10.

The coaxial cable 21 includes a core wire 28 as a center conductor, an insulator 29 as a dielectric, a metallic tape conductor (not shown) and a braid 30 as an outer conductor, and the insulative sheath 31 as an outer covering (see FIG. 1 and FIG. 2). The core wire 28 is disposed at the center of the coaxial cable 21, and the insulator 29 to the insulative sheath 31 are arranged in this order on the outside of this core wire. The core wire 28 to the insulative sheath 31 are already known, and detailed description will be omitted here.

The annular projecting braid portion 23, as well as the folded braid portion 24 formed by folding this annular projecting braid portion 23, is formed at an end portion of the coaxial cable 21. The annular projecting braid portion 23 as well as the folded braid portion 24 is disposed and formed at a position spaced a predetermined distance from an end face (see reference numeral 32 in FIG. 1 and FIG. 2) of the coaxial cable 21. First, the annular projecting braid portion 23 will be described specifically. The annular projecting braid portion 23 is formed by processing the braid 30, and is formed into such a shape that annular projecting braid portion 23 projects annularly outwardly from the insulative sheath 31 as shown by (a) in FIG. 1.

Here, the formation of the annular projecting braid portion 23 will be described. Assume that the end portion of the coaxial cable 21 is, for example, in a condition as shown in FIG. 2. First, an intermediate portion of the insulative sheath 31 is stripped as shown in FIG. 3, so that one insulative sheath 31*a* and the other insulative sheath 31*b* are formed respectively at the opposite sides of this stripped portion. The one insulative sheath 31*a* is disposed close to the end face 32 of the coaxial cable 21. The braid 30 is exposed from the above stripped portion.

Then, the one insulative sheath 31*a* is drawn toward the other insulative sheath 31*b* as shown in FIG. 4. At this time, in association with the drawing, the exposed braid 30 projects annularly outwardly from between end portions of the one insulative sheath 31*a* and the other insulative sheath 31*b*. When the braid 30 projects annularly outwardly, the annular projecting braid portion 23 is formed. An annular outer peripheral edge portion 33 of the annular projecting braid portion 23 is a portion formed as a result of folding the braid 30, and therefore wire elements forming the braid 30 are not loosened. The annular projecting braid portion 23 is formed according to this procedure.

In the condition in which the annular projecting braid portion 23 is formed, the most part of the braid 30 except this annular projecting braid portion 23 is covered with the other insulative sheath 31*b*, and therefore there is provided the structure in which the annular projecting braid portion 23 itself will not move. When the formation of the annular projecting braid portion 23 is completed, the process then shifts to the step of forming the folded braid portion 24.

In FIG. 1, FIG. 4 and FIG. 5, the folded braid portion 24 is formed by folding the annular projecting braid portion 23 from its proximal end portion 34 so as to superpose this annular projecting braid portion on the one insulative sheath 31*a*. The one insulative sheath 31*a* is covered with the folded braid portion 24 (In the drawings, although the whole of the outer surface of the one insulative sheath 31*a* is covered, this covering range is one example.). A distal end of the folded braid portion 24 is formed by the annular outer peripheral edge portion 33 of the annular projecting braid portion 24, and therefore is in a condition not requiring an end processing. When the proximal end portion 34 of the annular projecting braid portion 23 is bent, a terminal catching portion as designated by reference numeral 35 is formed at the folded braid portion 24.

The folded braid portion 24 is superposed on the one insulative sheath 31*a*, and therefore the terminal catching portion 35, when viewed from the other insulative sheath 31*b*, bulges outwardly from the other insulative sheath 31*b*, and is formed to provide an annular step. The terminal catching portion 35 is so formed as to function as a portion for catching the shield terminal 26 when a strong force is applied, for example, in a direction of withdrawing of the coaxial connector 22.

When the one insulative sheath 31*a* is drawn toward the other insulative sheath 31*b* at the time of forming the annular projecting braid portion 23, the insulator 29 is exposed, and when part of this insulator 29 is removed as shown in FIG. 6, the core wire 28 is exposed. The inner terminal 25 is electrically and mechanically connected to this exposed core wire 28 as shown in FIG. 7. The inner terminal 25 forming the coaxial connector 22 has electrical conductivity, and is formed into a pin-shape as shown in the drawings.

In FIG. 8, the shield terminal 26 forming the coaxial connector 22 includes a generally tubular shield terminal body 36, and a press-clamping portion 37 continuously formed at a rear portion of this shield terminal body 36. The shield terminal body 36 and the press-clamping portion 37 are formed by pressing a metallic thin sheet having electrical conductivity. The dielectric 27 is mounted within the shield terminal body 36 so as to be moved in a forward-rearward direction. The dielectric 27 is formed into such a shape that a distal end portion of the inner terminal 25 can be inserted into a center portion of this dielectric. The illustrated shapes of the shield terminal body 36, inner terminal 25 and dielectric 27 are given as one example.

The press-clamping portion 37 has a base plate 38 continuous with the shield terminal body 36, and the pair of braid press-clamping portions 39 adapted to be press-fastened at the position of the folded braid portion 24 of the coaxial cable 21 to be electrically and mechanically connected thereto, as well as the pair of sheath press-clamping portions 40 adapted to be press-fastened at a position near to the terminal catching portion 35 of the folded braid portion 24 to be mechanically connected to the other insulative sheath 31*b*, are formed at this base plate 38. Further, a step portion 41 of a generally semi-circular arc-shape corresponding to the terminal catching portion 35 is formed at the base portion 38 at a position between the pair of braid press-clamping portions 39 and the pair of sheath press-clamping portions 40.

The pair of braid press-clamping portions 39 are formed, for example, into a rectangular shape so as to be wound on the folded braid portion 24 of the coaxial cable 21. Like the pair of braid press-clamping portions 39, the pair of sheath press-clamping portions 40 are also formed, for example, into a rectangular shape so as to be wound on the other insulative sheath 31*b*. The pair of sheath press-clamping portions 40 are formed into the rectangular strip-shape smaller in width than the pair of braid press-clamping portions 39.

Next, the procedure of processing the end of the coaxial cable 21 based on the above construction will be described with reference to FIG. 8 to FIG. 10.

In FIG. 8, first, the folded braid portion 24 is formed, and thereafter an operation for preparing the coaxial cable 21 having the inner terminal 25 connected and fixed thereto is effected. Also, an operation for preparing the shield terminal 26 having the dielectric 27 mounted therein is effected. The formation of the folded braid portion 24 is effected as described above.

Then, in the condition of FIG. 8, an operation for inserting the inner terminal 25 into the shield terminal body 36 of the shield terminal 26 as shown in FIG. 9 is effected. Further, there is effected an operation in which the folded braid portion 24 of the coaxial cable 21 is press-clamped by the pair of braid press-clamping portions 39 of the shield terminal 26 to be electrically and mechanically connected thereto, and also the other insulative sheath 31*b* of the coaxial cable 21 is press-clamped by the pair of sheath press-clamping portions 40 at the position near to the terminal catching portion 35 of the folded braid portion 24 to be mechanically connected thereto. Through these operations, the connection and fixing of the coaxial cable 21 and the shield terminal 26 to each other are completed.

Finally, when an operation for sliding the dielectric 27 rearward so as to cause the dielectric 27 to hold the distal end of the inner terminal 25 as shown in FIG. 10 is effected, the coaxial connector 22 is completely mounted on the end portion of the coaxial cable 21, and the series of operations for the end processing are completed.

As described above with reference to FIG. 1 to FIG. 10, in the structure of processing the end of the coaxial cable 21, even when a strong force is applied, for example, in the direction of withdrawing of the coaxial connector 22, the terminal catching portion 35 of the folded braid portion 24 and the pair of sheath press-clamping portions 40 are caught and engaged with each other, and also the terminal catching portion 35 and the step portion 41 of the press-clamping portion 37 are caught and engaged with each other, that is, the metallic portions are caught and engaged with each other, and therefore damage is much less liable to occur as compared with the catching engagement of a synthetic resin-made portion and a metallic portion with each other as in the conventional example. Therefore, the tensile strength can be increased, and also the reliability can be enhanced.

In the present invention, various changes can be made in so far as the subject matter of the present invention is not changed.

Although the present invention has been described in detail with reference to the specific embodiments, it will be obvious to those skilled in the art that various changes and modifications can be added without departing from the spirits and scope of the present invention.

The present application is based on Japanese Patent Application (Patent Application No. 2007-221245) filed on Aug. 28, 2007, and its contents are incorporated herein by reference.

The invention claimed is:

1. An end-processing method of a coaxial cable, the end-processing method comprising:

stripping an intermediate portion of an insulative sheath of the coaxial cable to form one insulative sheath and an other insulative sheath;

drawing one insulative sheath toward the other insulative sheath and projecting a braid annularly outwardly from between end portions of the one insulative sheath and the other insulative sheath in association with the drawing to form an annular projecting braid portion; thereafter folding the annular projecting braid portion from its proximal end portion and superposing the folded annular projecting braid portion on the one insulative sheath to thereby form a folded braid portion; and press-clamping the folded braid portion by a braid press-clamping portion of a shield terminal for coaxial cable which is to be connected to an end portion of the coaxial cable, and also press-clamping and fixing a sheath press-clamping portion of the shield terminal for coaxial cable to the other insulative sheath disposed near to a terminal catching portion formed at the proximal end portion of the folded braid portion.

2. The end-processing method of the coaxial cable as set forth in claim 1, wherein a step portion corresponding to the terminal catching portion is formed at a base plate of a press-clamping portion of the shield terminal for coaxial cable, the base plate coupling the braid press-clamping portion to the sheath press-clamping portion.

3. The end-processing method of the coaxial cable as set forth in claim 1, wherein the sheath press-clamping portion is formed into a rectangular shape smaller in width than the braid press-clamping portion.

4. A coaxial connector manufactured by the end-processing method of the coaxial cable as claimed in claim 1.

5. A coaxial connector, comprising:

a coaxial cable including a core wire, an insulator, a braid, an insulative sheath, provided in order from a center of the coaxial cable; and a shield terminal including a body and a press-clamping portion formed at a rear portion of the body and receiving the coaxial cable therein, wherein the insulative sheath is divided into one insulative sheath and an other insulative sheath, and the one insulative sheath is disposed closer to an end face of the coaxial cable than the other insulative sheath is, wherein the braid is extracted and folded from a proximal end portion disposed between the one insulative sheath and the other insulative sheath and covers the one insulative sheath, to form a terminal catching portion formed at the proximal end portion of the folded braid, and wherein the press-clamping portion includes a braid press-clamping portion which is connected to the folded braid, and a sheath press-clamping portion which is fixed to the other insulative sheath near to the terminal catching portion.

6. The coaxial connector as set forth in claim 5, wherein a step portion corresponding to the terminal catching portion is formed at a base plate of the press-clamping portion, the base plate coupling the braid press-clamping portion to the sheath press-clamping portion.

* * * * *